US007165611B2

(12) United States Patent
Jones

(10) Patent No.: US 7,165,611 B2
(45) Date of Patent: Jan. 23, 2007

(54) SINGLE TRIP PERFORATION/PACKING METHOD

(75) Inventor: Ralph Harold Jones, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 293 days.

(21) Appl. No.: 10/458,035

(22) Filed: Jun. 10, 2003

(65) Prior Publication Data

US 2004/0251024 A1 Dec. 16, 2004

(51) Int. Cl.
*E21B 33/12* (2006.01)
*E21B 43/04* (2006.01)

(52) U.S. Cl. ..... 166/191; 166/187; 166/278; 166/297; 166/387

(58) Field of Classification Search ..... 166/297, 166/191, 185, 387, 278, 187, 337
See application file for complete search history.

(56) References Cited

U.S. PATENT DOCUMENTS

| | | | | |
|---|---|---|---|---|
| 4,372,384 | A | 2/1983 | Kinney | |
| 5,152,340 | A * | 10/1992 | Clark et al. | 166/122 |
| 5,156,213 | A | 10/1992 | George et al. | |
| 6,095,245 | A * | 8/2000 | Mount | 166/276 |
| 6,206,100 | B1 | 3/2001 | George et al. | |
| 6,364,017 | B1 | 4/2002 | Stout et al. | |

OTHER PUBLICATIONS

Halliburton One Trip Perf/Pack Completion System sales brochure published in 1996.

Halliburton STPP Single Trip Perf Pack Completion System sales brochure published in 1997.

Halliburton Frac Pack completion Services catalog, pp. 129-213 and Figure 12.9. This catalog was published in 1994.

Halliburton Sand Control Products and Services catalog, pp. 4-11. This catalog was published in 1997.

Documents pertaining to an offer of Sale to Pennzoil relating to West Cameron 580 field. These documents describe the Single Trip Perf Pack system offered for sale to Pennzoil in 1995.

Disclosure to Conoco, namely a PowerPoint presentation give to Conoco in 1997.

A Single Trip Perforation and Gravel Pack job performed for Spirit Energy, West Whitelake Completion, West Whitelake Field, offshore Louisiana, performed in Oct. 1998.

Eugene Island completion, including a Single Trip Perforation and Gravel Pack job, performed for Spirit Energy in the Eugene Island 276 field, offshore Louisiana, prior to Dec. 1998.

SPE Paper No. 13648, describing a Single Trip Perforating and Gravel Packing System developed by Baker Sand Control, published in 1985.

(Continued)

*Primary Examiner*—David Bagnell
*Assistant Examiner*—Giovanna M. Collins
(74) *Attorney, Agent, or Firm*—Marlin R. Smith

(57) ABSTRACT

A method for performing single trip perforation and packing operations via a downhole assembly in a cased well bore is described. The assembly is provided with an upper packer and a lower packer and has fluid communication established therethrough. The upper packer of the assembly is set to isolate a perforated production zone by introducing pressurized fluid through the assembly and against the casing below the lower packer of the assembly.

12 Claims, 2 Drawing Sheets

OTHER PUBLICATIONS

SPE Paper No. 50650, describing a Single Trip Perforating and Gravel Packing System developed by Schlumberger Dowel, published prior to Dec. 1998.

SPE Paper No. 39486, describing a Successful Completions in the Gulf of Mexico Using the Single-Trip Perforation and Packing System, published in 1998.

* cited by examiner

SINGLE TRIP PERFORATION/PACKING METHOD

BACKGROUND

Downhole packers are commonly used in many oilfield applications for the purpose of sealing against the flow of fluid to isolate one or more portions of a well bore for the purposes of testing, treating or producing the well. The packers are suspended in the well bore, or in a casing in the well bore, from a work string, or the like, and are activated, or set, so that one or more packer elements engage the inner surface of the well bore or casing to isolate various zones in the well bore.

Sand control methods are often used to prevent production of formation sand during downhole operations. According to one of these methods, a single trip process may be employed wherein perforation of a hydrocarbon interval (production zone) and setting of packing elements may be accomplished in one trip down the well bore. In a single trip perforation and packing process, a production screen is placed in the well bore, usually between an upper and lower packer. The packers are set and the annulus surrounding the production screen is then packed with a prepared sand/gravel slurry of a specific size designed to prevent the passage of formation sand. This also stabilizes the formation while causing minimal impairment to well productivity.

Conventional single trip sand control methods require a plugging device to be inserted into the above system to set the upper packer. To prevent the various tools and seals associated with the above-described assembly from becoming hydraulically locked after setting of the upper packer, a mechanical or hydraulic-operated venting device is typically inserted into the assembly to prevent hydraulic locking. However, this operation adds to the cost and time of the single trip sand control method.

Therefore, what is needed is an improved method for performing single trip perforating and packing operations within a well bore while eliminating the need to insert a plugging device to set the upper packer, thereby avoiding the problem of

DETAILED DESCRIPTION

Figure 1:
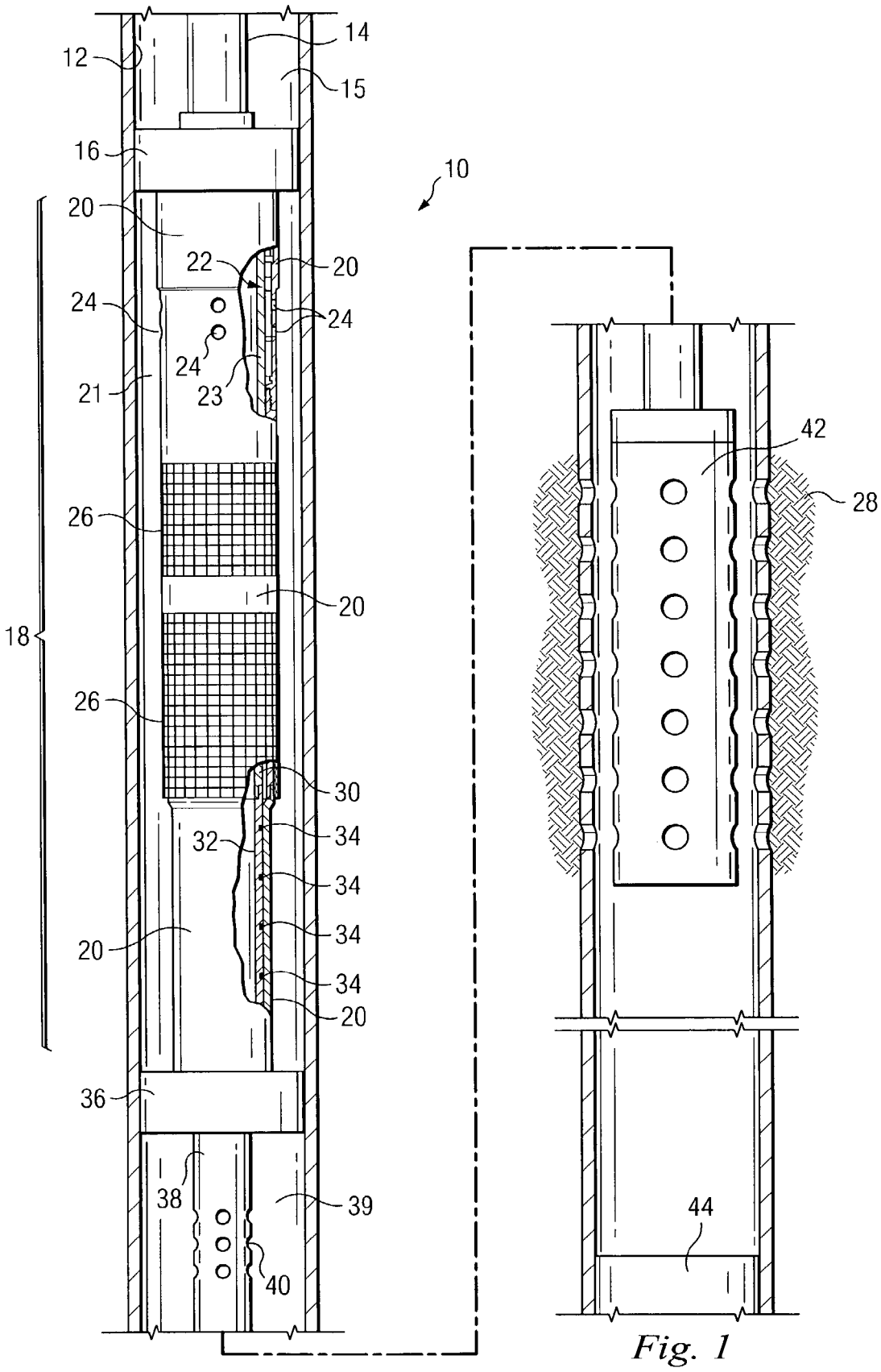
FIG. 1 is a schematical, elevational view of an assembly for performing sand control operations in a well bore according to an embodiment of the invention.
Figure 2:
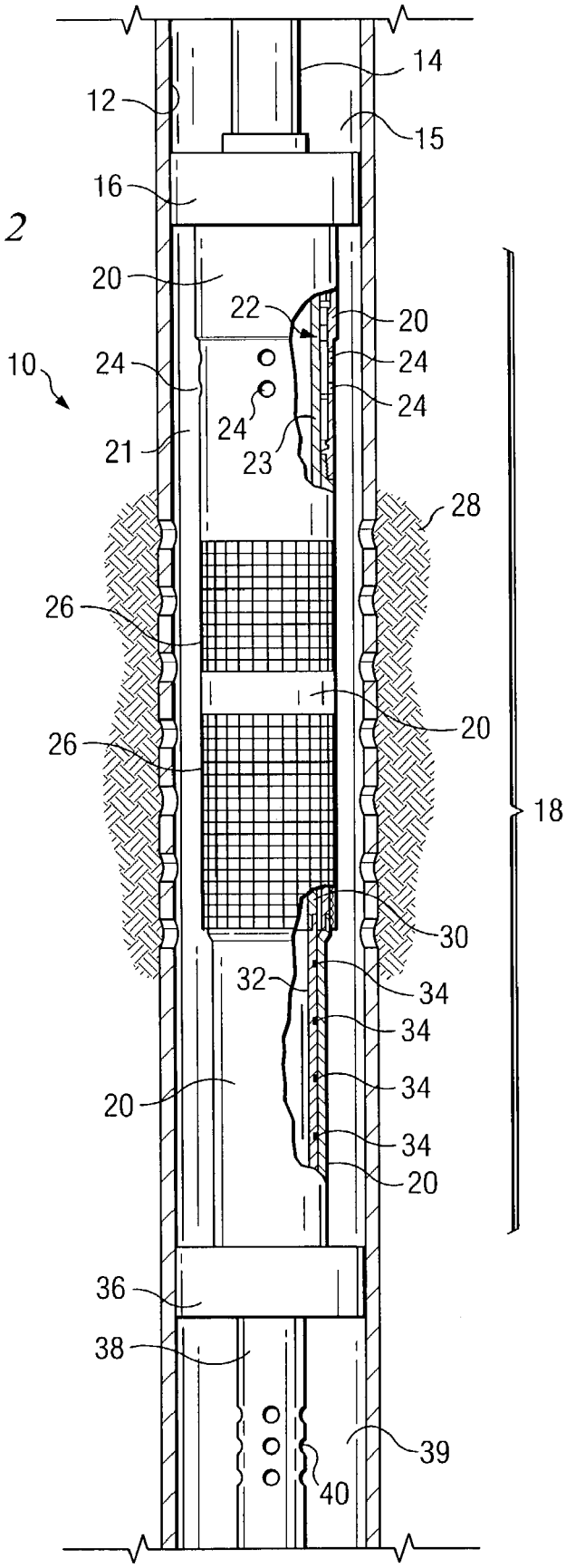
FIG. 2 is a schematical, elevational view of a portion of the assembly of FIG. 1 depicting the assembly lowered further into the well bore.

Referring to FIGS. 1 and 2, an assembly for performing single trip perforation and packing operations is referred to, in general, by the reference numeral 10 and is shown installed in a casing 12 disposed in a well bore. The assembly 10 includes a tubular conduit 14, such as a work string, which is lowered from a ground surface (not depicted) to a predetermined depth in the casing 12. The work string 14 and the casing 12 cooperate to define an annulus 15 between the work string and the casing.

The work string 14 is connected to an upper packer 16 having a longitudinal flow passage (not depicted) disposed therethrough such that fluid communication is established from the surface, through the work string, and to and through the upper packer. The upper packer 16 will be further described with respect to the operation.

A gravel pack assembly 18 is connected below the upper packer 16 and includes a tubular housing 20 for housing various components of the gravel pack assembly as will be described. The gravel pack assembly 18 and the casing 12 cooperate to define an annulus 21.

The gravel pack assembly 18 includes a service tool 22, a portion of which is depicted in FIG. 1, which is disposed within the housing 20 and operates to provide sand control operations as will be further described. The service tool 22 is of any hydraulic and/or mechanical design and, as such, will not be described in detail. One service tool 22 that may be used with the current method is disclosed in U.S. Pat. No. 4,372,384 and is incorporated herein by reference.

The service tool 22 includes a conduit 23 disposed concentrically with the housing 20 such that fluid communication is continued from the upper packer 16 to and through the service tool 22. A plurality of flow ports 24 are formed radially through the housing 20, and as shown in FIG. 1, do not initially fluidly communicate with the conduit 23. A pair of longitudinally-spaced, annular screen sections 26 are wrapped around corresponding sections of the housing 20 to aid in sand control operations during production of a production zone 28 as will be described.

A wash pipe 30, of which the downstream end is depicted in FIG. 1, is connected to the downstream end of the service tool 22 and extends through the section of housing 20 receiving the screen sections 26. The wash pipe 30 is connected to a tubular seal assembly 32, which is initially sealed into the housing 20. The seal assembly 32 includes a plurality of seals 34 for forming a sliding seal arrangement with the housing 20. The above-described arrangement allows for fluid communication to be established from the conduit 23 to and through the wash pipe 30 and the seal assembly 32.

A lower packer 36 is connected to the downstream end of the housing 20 via any conventional means. The lower packer 36 is a conventional packer which is set, or activated, causing it to engage the inner surface of the casing 12 to seal against the annular flow of fluids and permit hydraulic isolation of the production zone 28. The lower packer 36, like the upper packer 16, includes a longitudinal flow passage (not depicted) disposed therethrough such that fluid communication is continued from the tubular seal assembly 32 to and through the lower packer.

A section of tubing 38 connects to the downstream end of the lower packer 36 and extends therefrom. The tubing 38 and the casing 12 cooperate to define an annulus 39. A plurality of vent ports 40 are formed radially through the tubing 38 such that fluid communication is established from the lower packer 36, through the tubing 38, and into the annulus 39. Thus, fluid communication is established from the ground surface (not depicted), through the assembly 10, and to the vent ports 40.

A perforating gun assembly 42 is connected to the downstream end of the tubing 38 and is adapted to perforate the casing 12 to permit the flow of fluids into and from the casing. The gun assembly 42 is of a conventional design and, as such, comprises perforating guns and gun carriers and a mechanically or hydraulically operated firing head device with a ported sub. Since these components are all conventional they are not shown, nor will they be described, in detail. A plugging device 44 is disposed below the assembly 10 for reasons to be described with respect to the operation.

Referring to FIG. 2, a portion of the assembly 10 is shown lowered further into the well bore to a position where the screen sections 26 are placed adjacent the production zone 28.

In operation, referring to FIG. 1, the single trip assembly 10 is lowered, via the work string 14, into the well bore to position the gun assembly 42 adjacent the production zone 28. The lower packer 36 is set to isolate the production zone 28 during perforation. The perforating guns associated with the gun assembly 42 are then mechanically or hydraulically fired to perforate the casing 12 as shown.

Referring to FIG. 2, after the perforation is completed, the lower packer 36 and the gun assembly 42 (not depicted) are released and the work string 14 is positioned lower into the well bore, which positions the screen sections 26 adjacent the previously perforated production zone 28. The lower packer 36 is then set to seal off the annulus 39 from the annulus 21.

The lower packer 36 is then pressure tested by introducing pressurized fluid down and through the assembly 10 and against the casing 12 via the vent ports 40. The tubing 38 is closed off via any conventional means below the vent ports 40 to allow for the above-described fluid path. The plugging device 44 (FIG. 1) provides for the hydraulic integrity needed to conduct such a pressure test. The pressure test confirms whether or not the screen sections 26, and therefore the production zone 28, are hydraulically isolated above the lower packer 36. This is advantageous as pressure testing of the lower packer 36 is not possible with conventional sand control methods as such methods require a plugging device to be inserted into the assembly 10, thereby preventing fluid flow beyond the plugging device.

Upon sealing below the screen sections 26, the pressure of the pressurized fluid is increased and maintained through the assembly 10 and against the casing 12 below the lower packer 36 to cause setting of the upper packer 16. While passing through the service tool 22, the pressurized fluid exerts a hydraulic force on a hydraulic setting piston (not depicted) of the service tool 22. The setting piston converts the hydraulic force into a mechanical force, which the service tool 22 utilizes to set the upper packer 16. Thus, setting of the upper packer 16 is simplified as it is accomplished with the same method used to pressure test the lower packer 36, albeit using pressurized fluid having an increased pressure.

Upon setting of the upper packer 16, the upper packer is pressure tested by introducing pressurized fluid down the annulus 15 against the upstream end of the upper packer to ensure that the upper packer is properly set and the production zone 28 is properly isolated.

After setting and testing the upper packer 16, the service tool 22 is released and lifted from the housing 20 by hydraulic or mechanical means. By releasing and lifting the service tool 22, the seal assembly 32, which is connected to the service tool via the wash pipe 30, is disengaged from the housing 20. The problem of hydraulic locking of the service tool 22, the wash pipe 30, and the seal assembly 32 is eliminated as no plugging device was inserted into the assembly 10 to set the upper packer 16.

The service tool 22, via the flow ports 24, now serves as a pathway for pumping sand control treatment during production. As such, sand control operations commence in a conventional manner.

The above method mitigates against the possibility of hydraulic locking of the service tool 22 and the seal assembly 32 by eliminating the use of a plugging device, such as a packer setting ball, for setting the upper packer 16. Furthermore, additional tools, such as venting devices, do not need to be inserted into the assembly 10 to prevent hydraulic locking. Rather, the service tool 22, with the wash pipe 30 and seal assembly 32 attached thereto, are released and lifted without the problem of hydraulic locking. Thus, setting time of the assembly 10 is reduced and associated problems of placing a plugging device in the assembly to set the upper packer 16 are eliminated.

It is understood by those skilled in the art that various changes in form and detail may be made therein without departing from the spirit and scope of the invention. For example, a variety of service tools 22 may be used to implement the described method. Furthermore, a variety of seal assemblies 32 may be used to achieve a sliding seal arrangement with the housing 20. For example, the seal assembly 32 may employ radially compressed molded seals. Moreover, the number of screen sections 26 is variable and is not limited to the arrangement of two screen sections as described. Furthermore, the plugging device 44 may be any of a variety of plugging devices such as a bridge plug.

Still further, the invention is not limited to the perforating process as described, but is equally applicable to other perforating methods. Moreover, a variety of additional tools may be used with the described method to accomplish various other downhole operations. Since other modifications, changes, and substitutions are intended in the foregoing disclosure, it is appropriate that the appended claims be construed broadly and in a manner consistent with the scope of the invention.

What is claimed is:

1. A method of setting a first packer of a downhole assembly placed in a well bore, the method comprising the steps of:

providing the assembly with a second packer spaced apart from the first packer;

establishing fluid communication through the assembly to a portion of the well bore external to the assembly and opposite the second packer from the first packer; and introducing pressurized fluid through the assembly, and into the well bore portion to set the first packer.

2. A method of isolating a zone in a well bore, the method comprising the steps of:

providing an assembly having a first packer and a second packer, wherein fluid communication is established through the assembly;

setting the second packer on a first side of the zone, thereby isolating the zone from a portion of the well bore external to the assembly; and introducing pressurized fluid through the assembly and into the well bore portion to set the first packer on a second side of the zone opposite from the first side.

3. The method of claim 2 wherein the step of introducing pressurized fluid through the assembly and into the well bore portion tests hydraulic isolation across the second packer.

4. The method of claim 2 wherein the assembly further includes a tubing connected to the second packer, the tubing having at least one vent port formed therethrough for establishing fluid communication between the assembly and the well bore portion.

5. The method of claim 2 wherein the assembly further includes a work string for lowering the assembly into the well bore.

6. The method of claim 5 wherein the work string and the well bore cooperate to define an annulus and wherein the first packer is pressure tested by introducing pressurized fluid through the annulus and against an end of the first packer.

7. A method of performing sand control operations in a single trip into a well bore, the method comprising the steps of:

providing an assembly having a perforating device, first and second packers, and a screen section, wherein fluid communication is established through the assembly;

positioning the assembly so that the first packer and the second packer are on opposite first and second sides of the zone with the screen section between the first and second packers;

setting the second packer on the first side of the production zone; and introducing pressurized fluid through the assembly and into the wellbore opposite the second packer from the first packer to thereby set the first packer on the second side of the zone and hydraulically isolate the zone.

8. The method of claim 7 wherein the step of introducing pressurized fluid through the assembly tests hydraulic isolation across the second packer.

9. The method of claim 7 wherein the assembly further includes a tubing connected to an end of the second packer, the tubing having at least one vent port formed therethrough for establishing fluid communication between the assembly and the well bore.

10. The method of claim 7 wherein the assembly further includes a work string for lowering the assembly into the well bore.

11. The method of claim 10 wherein the work string and the well bore cooperate to define an annulus and wherein the first packer is pressure tested by introducing pressurized fluid through the annulus and against an end of the first packer.

12. The method of claim 7, further comprising the steps of:

lowering the assembly to position the perforating device adjacent a zone;

commencing perforating operations to perforate the zone; and commencing sand control operations through the assembly.

* * * * *